US005298701A

United States Patent [19]

Sandor

[11] Patent Number: 5,298,701

[45] Date of Patent: Mar. 29, 1994

[54] PLUG AND SWITCH INTERLOCK INCLUDING GEAR AND LATCH ASSEMBLY

[75] Inventor: John L. Sandor, Wallingford, Conn.

[73] Assignee: Hubbell Incorporated, Orange, Conn.

[21] Appl. No.: 986,369

[22] Filed: Dec. 7, 1992

[51] Int. Cl.[5] ..... H01H 9/20; H01H 13/70

[52] U.S. Cl. ..... 200/50 B

[58] Field of Search ..... 200/50 R, 50 A, 50 B, 200/50 C, 51 R-51.17, 501, 318-327

[56] References Cited

U.S. PATENT DOCUMENTS 1,556,831 10/1935 Wyman ..... 200/50 B
3,716,683 2/1973 Hafer ..... 200/50 B X
4,553,000 11/1985 Appleton ..... 200/50 B

FOREIGN PATENT DOCUMENTS 2342805 3/1975 Fed. Rep. of Germany .
3513591 10/1986 Fed. Rep. of Germany .

OTHER PUBLICATIONS

Hubbell Pin & Sleeve connector brochure, pages 2, 6 and 11, pub. 1985.

*Primary Examiner*—J. R. Scott

*Attorney, Agent, or Firm*—Jerry M. Presson; Walter C. Farley

[57] ABSTRACT

A switch enclosure has a receptacle to receive a pin and sleeve plug having a key on the outside of the sleeve. A handle on the outside of the enclosure operates the switch through a gear train. An interlock mechanism has a sliding latch which prevents the gear train from turning unless the plug is fully inserted so that the key can remove the sliding latch from recesses in one of the gears. Two recesses are provided to inhibit defeat of the interlock mechanism.

14 Claims, 6 Drawing Sheets

PLUG AND SWITCH INTERLOCK INCLUDING GEAR AND LATCH ASSEMBLY

FIELD OF THE INVENTION

This invention relates to a high current switch operator mounted in a closed housing having a receptacle, the housing having an interlock mechanism to prevent operation of the switch to the ON position unless a plug is properly inserted in the receptacle.

BACKGROUND OF THE INVENTION

In the manufacture and use of switch boxes of the type which have receptacles to receive plugs and which are designed to handle relatively high currents, such as 30 amperes to 60 amperes or above, it is considered unsafe to allow the switch to be moved to its ON position in the absence of a properly inserted plug. Attempting to insert or remove a plug into or from an energized receptacle, especially with a load connected to the plug, can result in arcing between the plug and receptacle with damage to the components as well as a safety hazard to personnel. To prevent this occurrence, switches housed with receptacles (as distinguished from those which are permanently wired into a system) are commonly provided with some type of interlock.

One type of switch housing with an interlock is shown in German patent document 23 42 805. As shown therein, a switch handle is provided with a non-circular coupling to directly operate a conventional switch. A gear train engages teeth on the switch handle, one of the gears having a locking relationship with a spring-urged slider so that the gear train is not rotatable unless the slider is moved to an unlooking position. The slider is adjacent a receptacle shaped and dimensioned to receive a plug of the type having a protruding cam. When the plug is properly inserted, the cam moves the slider and releases the gears so that they can turn, allowing the switch to be turned on after the plug is in. Also, a latching member rotates with the gears to a position behind the cam, preventing extraction of the plug until the switch handle has been rotated to the OFF position.

While this mechanism is functional, it is possible to defeat the mechanism and it is also subject to malfunction. Because the handle is connected to a shaft which directly operates the switch, it is possible to force the handle and the switch, causing the gears to deform or break and jump out of their normal meshing relationship. That kind of interlock mechanism thus depends on the integrity of the gear train for its effectiveness.

It is also possible to defeat that mechanism by inserting a common probe type of tool, such as a screwdriver, an ice pick or a pencil, to push the latch and begin the rotation of the gear train, extract the probe and then continue the rotation until the switch is operated to the ON position, thus defeating the interlock mechanism.

SUMMARY OF THE INVENTION

Accordingly, an object of the present invention is to provide a switch operator in a receptacle housing with an improved interlock to prevent operation of the switch to an ON position unless a plug is properly inserted into the receptacle and to prevent extraction of the plug so long as power is being supplied to the receptacle.

Briefly described, the invention comprises an interlock mechanism for an electrical switch and receptacle which are mounted in a housing. The receptacle has an end exposed for receiving a plug with an external key. The switch has a rotatable switch operator and a first gear is coupled to the switch operator so that rotation of the first gear operates the switch between ON and OFF positions. A movable handle on an outer surface of the housing wall is connected to a stem which penetrates the wall and is attached to a second gear inside of the housing. The second gear is coupled to the first gear so that rotation of said second gear causes rotation of said first gear and the switch. A latch is provided for engaging a recess in the second gear when the gears are in a position corresponding to the OFF position of the switch to prevent rotation of said gears, the latch being located in the path of the key so that it is moved out of the recess when the plug is inserted into the receptacle. Thus, full insertion of the proper plug releases the gears and the switch operator for rotation to the ON position.

BRIEF DESCRIPTION OF THE DRAWINGS

In order to impart full understanding of the manner in which these and other objects are attained in accordance with the invention, a particularly advantageous embodiment thereof will be described with reference to the accompanying drawings, which form a part of this disclosure, and wherein.

DESCRIPTION OF THE PREFERRED EMBODIMENT

Figure 1:
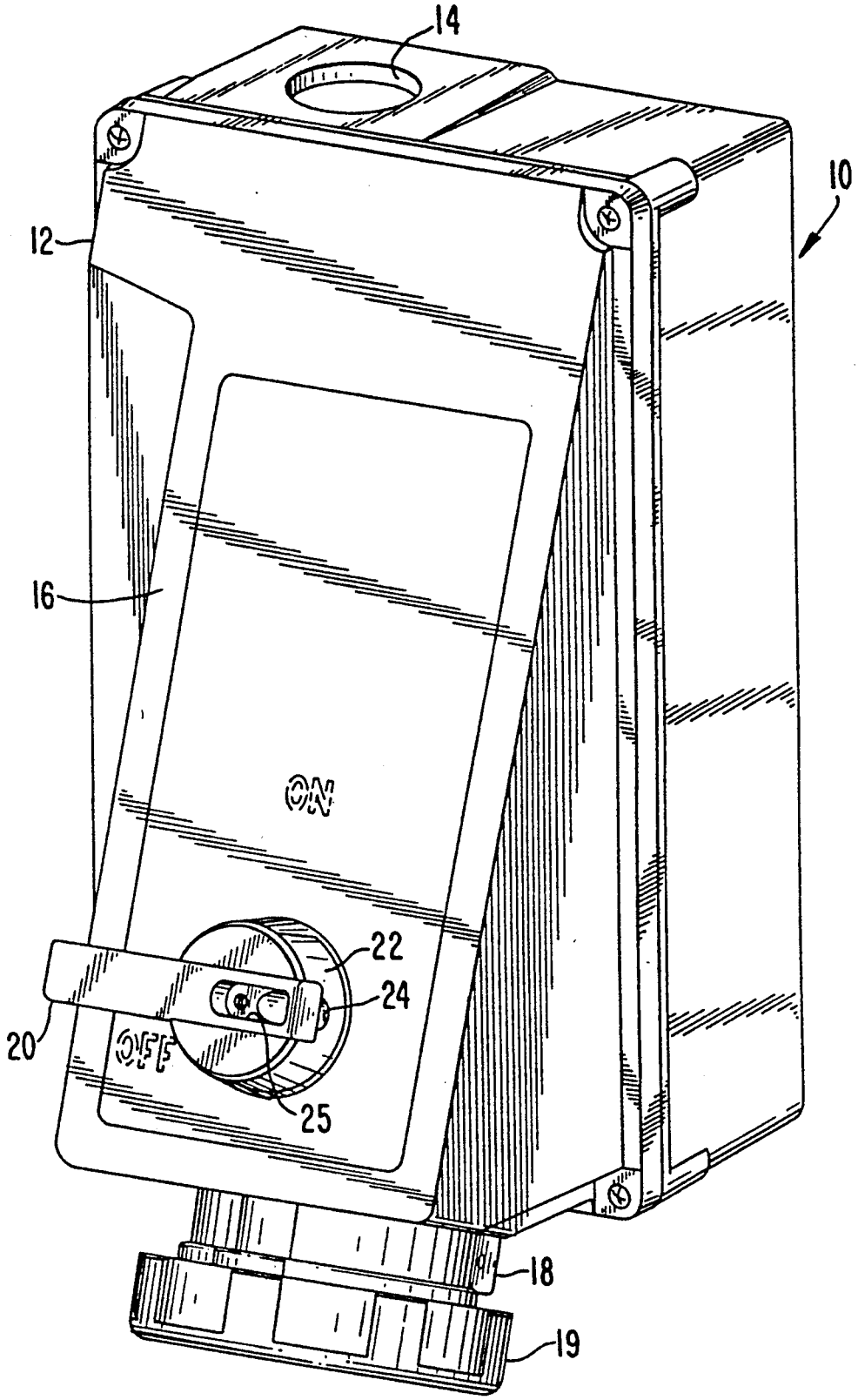
FIG. 1 is a perspective view of a housing having a switch handle and receptacle and incorporating a mechanism in accordance with the invention.
Figure 2:
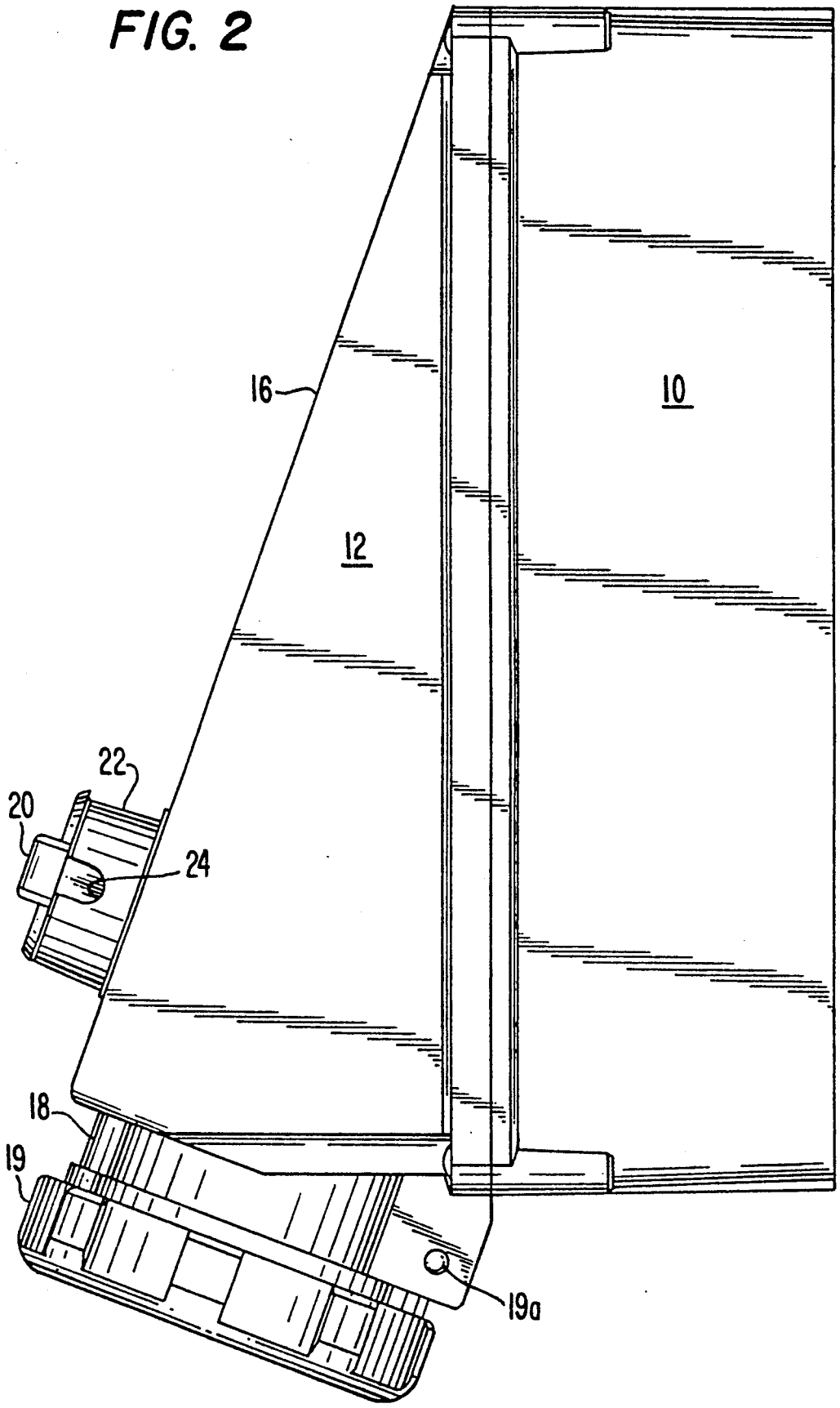
FIG. 2 is a side elevation of the housing of FIG. 1.

As seen in FIGS. 1 and 2, the receptacle housing to which the invention has been applied includes a generally rectangular box indicated generally at 10 having an open front which is closed by a cover 12. At the top or bottom of box 10 is a hole 14 which typically receives a standard internally threaded fitting for connection to electrical conduit carrying wires supplying power to the interior of the box. At least part of the front face 16 of cover 12 slopes outwardly and downwardly, forming a generally triangular front portion, the bottom of which is provided with a tubular projection 18 to receive an electrical plug. Projection 18 is closed by an openable lid 19 which swings or pivots about an axis **19*a* away from the opening in projection 18** to permit insertion of the plug.

A switch handle 20 is mounted on the front face of the cover and is rotatable between an OFF position shown in FIG. 1 and an ON position in which the longer portion of the handle is rotated clockwise 90°, the two positions being indicated by appropriate legends on the face. A generally cylindrical or conical wall 22 partially surrounds the switch handle and can be used to form stops to limit the extent of rotation of the handle. Also, wall 22 and handle 20 are provided with openings 24 and 25 respectively which align at one or more predetermined positions of rotation to permit locking the handle, using the hasp of a conventional padlock or the like.

Figure 3:
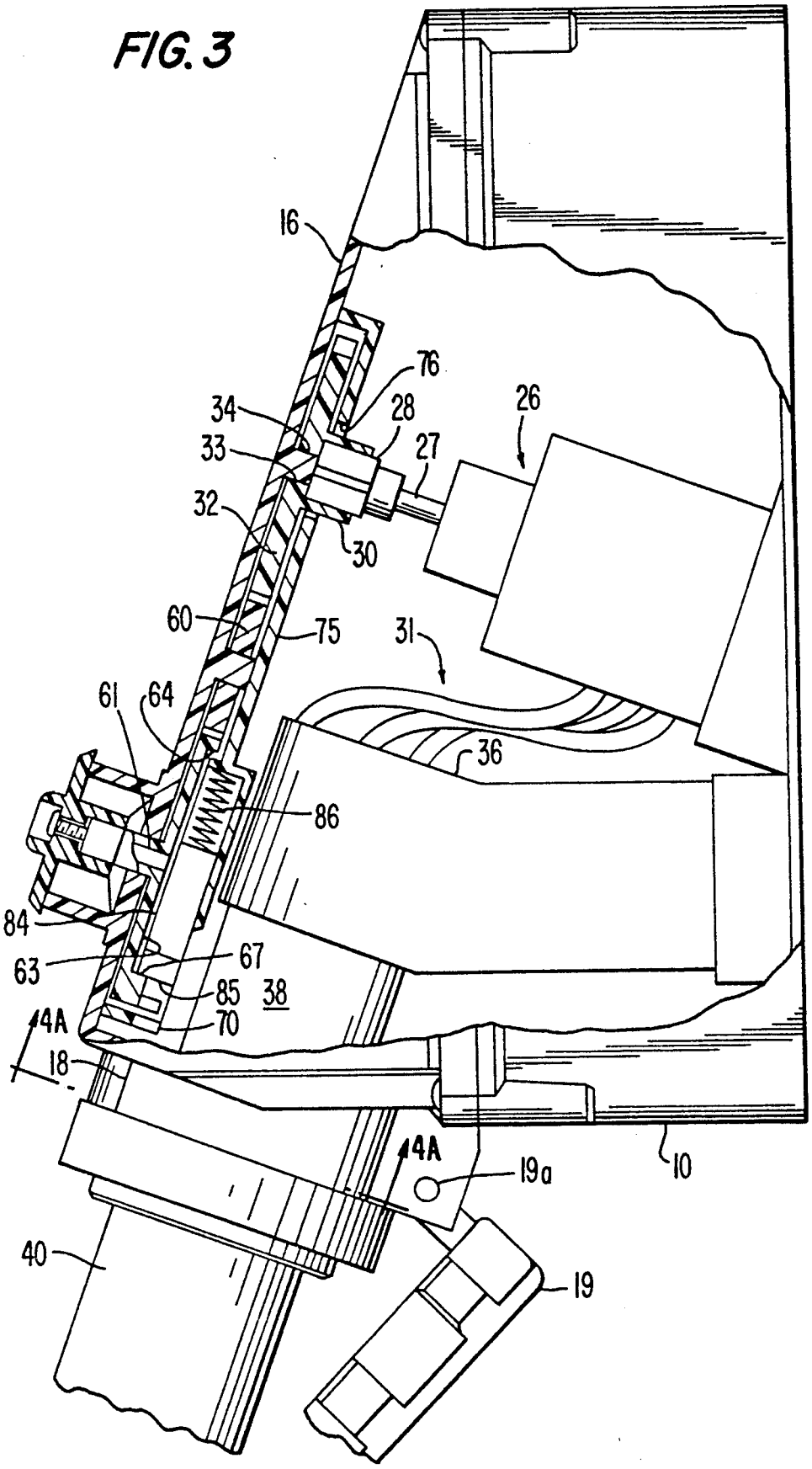
FIG. 3 is a side elevation partly cut away to show the location of a mechanism in accordance with the invention.

As seen in FIG. 3, a conventional electrical switch indicated generally at 26 is mounted inside box 10, the switch having a rotatable switch operator shaft 27 attached to a non-circular coupling member 28. Typically, coupling 28 comprises a generally cylindrical tube unitarily formed with three non-uniformly spaced lobes or ears of different sizes so that a mating member must be assembled thereto in only one, unique circular orientation. In the apparatus of FIG. 3, the mating member is a socket 30 which is formed as part of a rotatable gear 32. Gear 32 has a circular central opening 33 which receives a circular boss 34 formed on the inner surface of front wall 16.

Toward the bottom of the box 10 is a mounting 36 for a generally cylindrical receptacle 38 which extends into tubular projection 18. The details of the mounting are not important to the invention except that it holds the receptacle in the proper position. In the embodiment shown, receptacle 38 is a receptacle for a type of connector known as a pin and sleeve connector in which the plug portion 40, shown in outline in FIG. 3 partially inserted, in partial side elevation in FIG. 4B and in a transverse sectional view in FIG. 4A, has a tubular sleeve 42 of electrically non-conductive material and a plurality of pins 44 extending axially (parallel with the axis of the sleeve) within sleeve 42. The pins are made of a good electrical conductor and act as the electrical contacts for the plug and can be arranged in a variety of ways, depending on the current and voltage ratings for the connector, so that it can only be joined with a receptacle of similar rating. Typically, one pin is larger than the others to further assure connection to a receptacle of the proper rating. The receptacle has a cylindrical body 46, made of an electrically non-conductive material, which is slidably received inside the sleeve of the plug and has a plurality of openings 48 dimensioned and positioned to receive the pins 44, each of the receptacle openings having conductive walls 50 to make good electrical contact with the pins of the plug. Walls 50 are connected to wires 31 which lead to the switch so that operation of the switch with a plug inserted supplies power to the plug pins which are, in turn, connected to a cable.

Figure 4A:
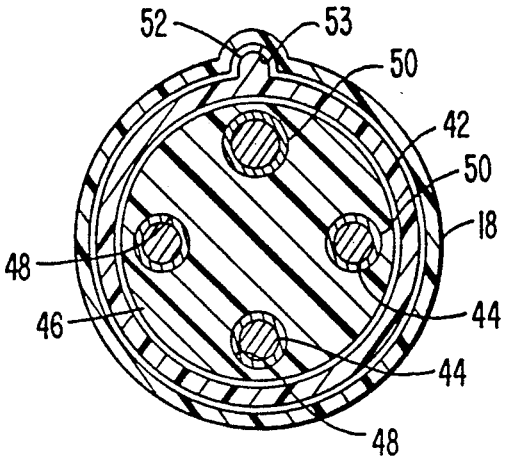
FIG. 4A is a sectional view along line 4A—4A of FIG. 3.
Figure 4B:
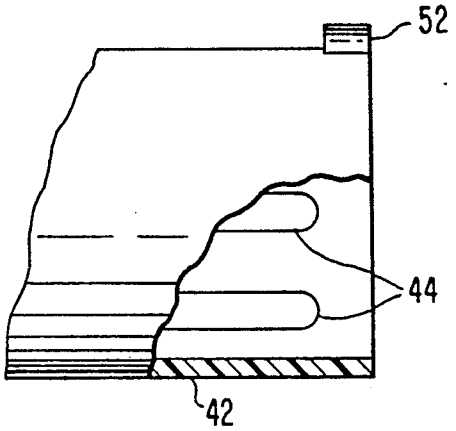
FIG. 4B is a partial side elevation of a pin and sleeve plug usable with the receptacle of FIGS. 1 and 4A.

While most of the details of the pin and sleeve connector itself are not critical and, being well-known, will not be further described, there is one feature of the plug which is quite important to the interlock mechanism. On the outer surface of the sleeve of the plug is a cam or key 52 which is received in a slot 53 along the inner surface of tube 18 (FIG. 4A). Key 52 is axially rather short compared with the length of the sleeve and, when the plug is fully mated with the receptacle, is completely within the housing, having passed entirely through tube 18. This key is used to release the interlock as will be described. A plug from which the key has been removed will not allow the switch to be operated.

Figure 5:
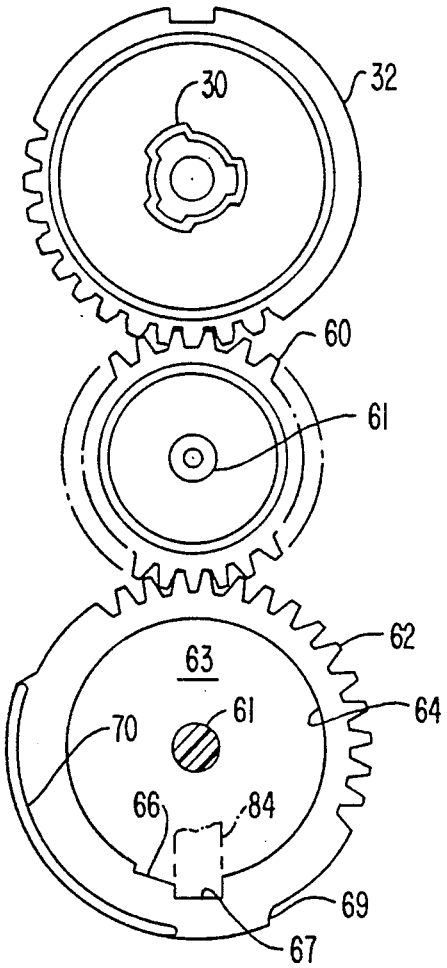
FIG. 5 is an inside view of the cover and interlock mechanism of the housing of FIGS. 1–3 with the mechanism in a first position.

As seen in FIG. 5, gear 32 (which is coupled to the switch) meshes with an idler gear 60 which has teeth around its entire periphery and which in turn meshes with a latching gear 62. Gear 32 has teeth over only about 145° of its periphery, the remainder being without any teeth, thereby limiting the extent of rotation of the gear train. Gear 62 is similarly formed with teeth about only part of its periphery and a central stem 61 passes through cover 16 and ends in a non-circular plug which enters a mating socket in handle 20 and is fixedly attached thereto so that rotation of handle 20 tends to rotate gear 62 if the gear is free to rotate.

Gear 62 performs several functions and is shaped accordingly, internally and externally. In particular, as seen in FIGS. 3 and 5, the central portion of gear 62 is thinner than the periphery, forming a recess 63 which is bounded by a mostly circular wall 64. However, one portion of wall 64 departs from the circular shape and has two steps 66 and 67 of larger radii than the remainder of the wall, step 67 having a larger radius than step 66. Steps 66 and 67 have substantially the same width or arcuate length.

The outer periphery of gear 62 also has a radial enlargement 69 which occupies about 140° of arc and which carries an axially (with respect to the axis of the gear) extending wall 70. One end of wall 70 is substantially aligned with the separation between steps 66 and 67, best seen in FIG. 5, and the other end of wall 70 is about 105° away in a clockwise direction.

Figure 8:
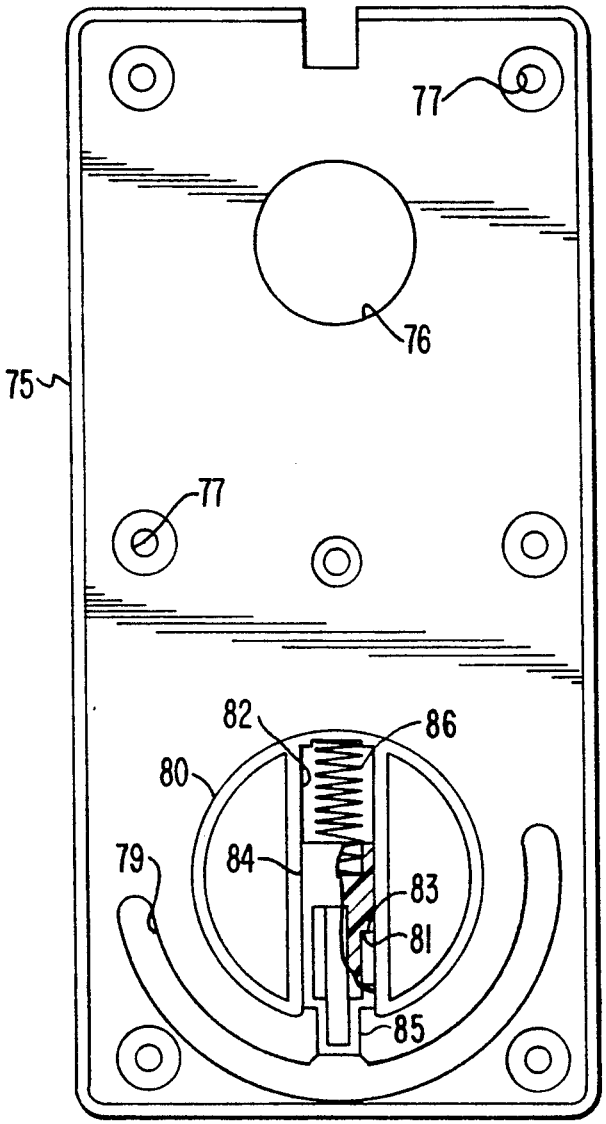
FIG. 8 is a view of the inside of the gear cover of the mechanism of FIGS. 3, 5 and 6.

An inner cover 75, seen in section in FIG. 3 and in plan in FIG. 8, has a circular opening 76 which surrounds socket 30 on gear 32 and screw holes 77 by which cover 75 is attached to the inner surface of cover 16. At the lower end of cover 75 is an arcuate slot 79 which receives wall 70. Radially within slot 79 is a circular boss 80 which fits into recess 63 of gear 62 and within that boss is a longitudinal slot 82. A sliding latch 84 is slidably received in slot 82 and is free to move longitudinally therein, i.e., up and down as shown in FIG. 8. However, the latch cannot move sideways because it is confined by slot 82. Latch 84 has a large end which is uppermost in FIG. 8 and a smaller end 85. A compression coil spring 86 acts between the larger end of latch 84 and an end of slot 82 to urge end 85 of the latch toward arcuate slot 79. However, cooperating shoulders 81 and 83 on the latch and on slot 82 limit the movement of the latch in the direction of slot 79 to a position in which end 85 of the latch does not enter arcuate slot 79.

The width of end 85 of the latch is dimensioned to substantially coincide with the widths or arcuate lengths of each of steps 66 and 67 of gear 62. As shown in dashed lines in FIG. 5, when gear 62 is rotated so that step 67 is aligned with slot 82, end 85 of the latch enters step 67 and prevents gear 62 from rotating in either direction. This is also the position shown in FIG. 3. As will be recognized from the above, handle 20 is attached to gear 62 and switch 26 is operated by rotation of gear 32. Thus, in order for the handle to operate the switch, the gears all must be able to rotate.

Figure 9:
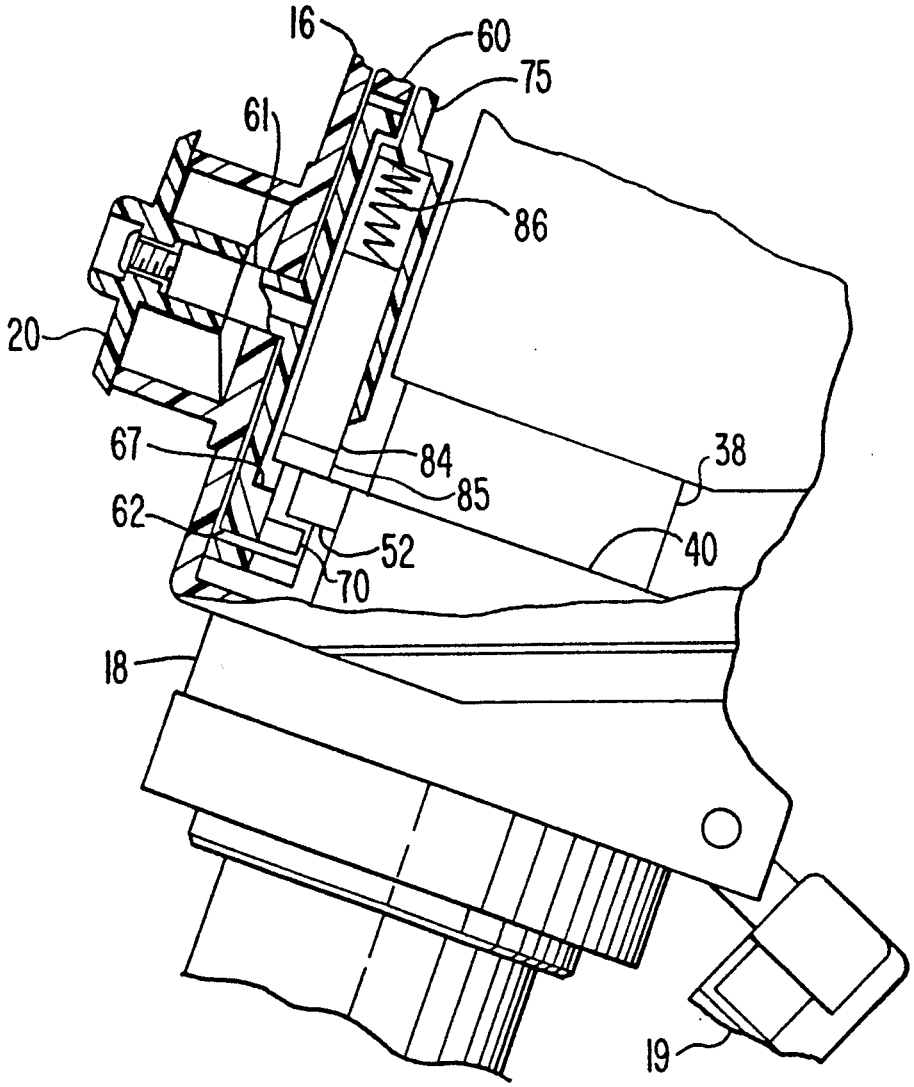
FIG. 9 is a partial sectional view similar to FIG. 3 showing the latch mechanism in the release position.

In order to release the latch, as shown in FIG. 9, plug 40 is fully inserted, allowing key 52 to enter the housing and push against end 85 of latch 84, moving the latch out of step 67. With end 85 of the latch fully removed from the step recess, gear 62 is free to rotate. By then fully rotating handle 20 to the ON position, two things are accomplished: first, switch 26 is operated by rotation of gears 60 and 32 as well as socket 30, operator 28 and shaft 27. Second, rotation of gear 62 rotates wall 70 into the position shown in FIG. 7 in which the wall passes outside of the trailing end of key 52, preventing the key and, of course, the plug from being extracted from the socket. This prevents one from inserting the plug, turning on the power and then removing the plug while the power is on.

Figure 6:
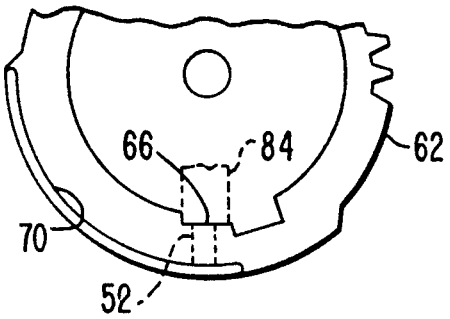
FIGS. 6 and 7 are partial views of the interlock mechanism of FIG. 5 in second and third position.
Figure 7:
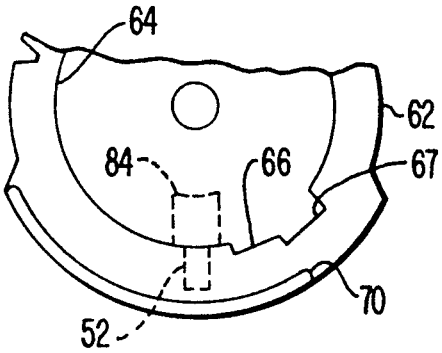

FIG. 7 shows the end of the latch fully removed from steps 66 and 67 so that gear 62 is freely rotatable to the extent of its toothed engagement with gear 60. Step 66 provides an important latching function which prevents the interlock from being circumvented with the use of a pencil or similar probe. If one inserts a probe into the plug so that it presses the end 85 of the latch out of recess 67 and then turns the handle to try to turn the switch ON, wall 70 rotates so that it is necessary to remove the probe. It is possible with such a probe to rotate gear 62 to the point at which end 85 of latch 84 catches on the edge of step 66 as the probe is withdrawn. Gear 62 can then be rotated so that the latch is fully out of step 67. However, gear 62 cannot be turned beyond that point because the latch is caught in step 66, in the position shown in FIG. 6. This prevents one from defeating the switch with a probe-type tool.

Also, if a person using the equipment turns the switch handle toward the OFF position but does not turn it completely off, and then tries to extract the plug, moving it a small axial distance, latch member 84 enters step 66. In this position, wall 70 still engages key 52 so that the plug cannot yet be removed; and the latch member in the step prevents the switch mechanism from being returned to the ON position. In order to perform one of these functions, the user must either turn the switch handle completely to the OFF position, allowing removal of the plug, or must return the plug to its fully inserted position, allowing restoration of power. The same is true if the user does not initially insert the plug all the way: again, the latch is removed from step 67 but can still engage step 66, preventing power from being turned on.

Because the switch operator is not connected to the same gear which is directly driven by handle 20, stress on the gears is limited to that necessary to operate the switch and it is substantially impossible to overcome the interlock mechanism without some sort of special tool. One must either comply with the full insertion requirement of the plug or power cannot be supplied to the plug and the load to which it is connected.

While certain advantageous embodiments have been chosen to illustrate the invention, it will be understood by those skilled in the art that various changes and modifications can be made therein without departing from the scope of the invention as defined in the appended claims.

What is claimed is:

1. An interlock mechanism for an electrical switch and receptacle comprising the combination of a housing containing a switch and having a wall;

a rotatable switch operator on said switch;

a first gear coupled to said switch operator so that rotation of said first gear operates said switch between ON and OFF positions;

a movable handle on an outer surface of said wall, said handle being connected to a stem penetrating said wall;

a second gear attached to said stem inside of said housing and coupled to said first gear so that rotation of said second gear causes rotation of said first gear;

means on said second gear defining a recess;

a receptacle mounted on said housing, said receptacle having an end exposed for receiving a plug having a external key; and latch means for engaging said recess when said gear is in a position corresponding to said OFF position of said switch to prevent rotation of said gears, said latch means being located in a path to be moved out of said recess by said key when said plug is inserted into said receptacle whereby full insertion of said plug releases said gears and switch operator for rotation to said ON position.

2. A mechanism according to claim 1 and including a third gear interposed between said first and second gears and coupling said first and second gears for concurrent rotation.

3. A mechanism according to claim 2 wherein said wall is a front wall of said housing, said first, second and third gears being mounted for rotation on an inner surface of said front wall.

4. A mechanism according to claim 3 and further comprising an inner cover attached to said inner surface of said front wall and wherein said latch means includes means defining a slot in said inner cover, a latch member slidable in said slot between a latching position in which said latch member engages said recess in said second gear and a released position in which said latch means is extracted from said recess, and a spring urging said latch member toward said latching position.

5. A mechanism according to claim 4 wherein said second gear further includes an arcuate wall rotatable with said second gear to engage said key when said plug is fully inserted and said second gear is rotated from said OFF position to thereby prevent removal of said plug.

6. A mechanism according to claim 5 wherein said second gear includes means defining a second recess adjacent the first-mentioned recess for receiving said latch member when said plug is inserted sufficiently to remove said latch member from said first recess but not fully inserted to prevent further movement of said gears toward said ON position to thereby indicate that said plug is not fully inserted.

7. A mechanism according to claim 1 wherein said wall is a front wall of said housing, said gears being mounted for rotation on an inner surface of said front wall, said mechanism further comprising an inner cover attached to said inner surface of said front wall and wherein said latch means includes means defining a slot in said inner cover, a latch member slidable in said slot between a latching position in which said latch member engages said recess in said second gear and a released position in which said latch means is extracted from said recess, and a spring urging said latch member toward said latching position.

8. A mechanism according to claim 7 wherein said second gear further includes an arcuate wall rotatable with said second gear to engage said key when said plug is fully inserted and said second gear gear is rotated from said OFF position to thereby prevent removal of said plug.

9. A mechanism according to claim 8 wherein said second gear includes means defining a second recess adjacent the first-mentioned recess for receiving said latch member when said plug is inserted sufficiently to remove said latch member from said first recess but not fully inserted to prevent further movement of said gears toward said ON position to thereby indicate that said plug is not fully inserted.

10. A mechanism according to claim 1 wherein said second gear further includes an arcuate wall rotatable with said second gear to engage said key when said plug is fully inserted and said second gear is rotated from said OFF position to thereby prevent removal of said plug.

11. An interlock mechanism for an electrical switch and receptacle comprising the combination of a housing containing a switch and having a wall;

a rotatable switch operator on said switch;

a first gear coupled to said switch operator so that rotation of said first gear operates said switch between ON and OFF positions;

a movable handle on an outer surface of said wall, said handle being connected to a stem penetrating said wall;

a second gear attached to said stem inside of said housing and coupled to said first gear so that rotation of said second gear causes rotation of said first gear;

means on said second gear defining first and second recesses adjacent to each other and separated by a shoulder;

an arcuate wall on said second gear, said wall having an end aligned with said shoulder between said recesses;

a receptacle mounted on said housing, said receptacle having an end exposed for receiving a plug having a external key; and latch means for engaging said first recess when said gear is in a position corresponding to said OFF position of said switch to prevent rotation of said gears, said latch means being located in a path to be moved out of said first recess by said key when said plug is inserted into said receptacle whereby full insertion of said plug releases said gears and said switch operator for rotation to said ON position and for engaging said second recess when said plug is inserted sufficiently to remove said latch member from said first recess but not fully inserted, thereby to prevent further movement of said gears toward said ON position and to indicate that said plug is not fully inserted.

12. A mechanism according to claim 11 wherein said key has a predetermined axial length no greater than the distance between said second recess and said arcuate wall whereby said switch cannot be operated by a device having a greater length than said key.

13. A mechanism according to claim 11 wherein said second gear rotates in a counterclockwise direction when moving from said OFF position to said ON position, and wherein said wall extends clockwise from said end to form a barrier between said latch and said receptacle except when said second gear is in said OFF position.

14. A mechanism according to claim 11 wherein said second gear rotates in a clockwise direction when moving from said OFF position to said ON position, and wherein said wall extends counterclockwise from said end to form a barrier between said latch and said receptacle except when said second gear is in said OFF position.

* * * * *